US010777943B2

(12) United States Patent
Zhang et al.

(10) Patent No.: US 10,777,943 B2
(45) Date of Patent: Sep. 15, 2020

(54) CONNECTOR WITH A CONDUCTIVE SHIELD HAVING A C-SHAPED RING

(71) Applicant: Tyco Electronics (Shanghai) Co. Ltd., Shanghai (CN)

(72) Inventors: Jiefeng Zhang, Shanghai (CN); Hao Wang, Shanghai (CN); Qijun Zhao, Shanghai (CN); Ning Wang, Shanghai (CN); Jianfei Yu, Shanghai (CN); Bo Gao, Shanghai (CN); Biao Pan, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/578,879

(22) Filed: Sep. 23, 2019

(65) Prior Publication Data

US 2020/0021063 A1 Jan. 16, 2020

Related U.S. Application Data

(63) Continuation of application No. PCT/EP2018/057207, filed on Mar. 21, 2018.

(30) Foreign Application Priority Data

Mar. 22, 2017 (CN) ..... 2017 2 0287264 U

(51) Int. Cl.
*H01R 13/6592* (2011.01)
*H01R 9/03* (2006.01)
(Continued)

(52) U.S. Cl.
CPC ..... *H01R 13/6592* (2013.01); *H01R 9/03* (2013.01); *H01R 13/6582* (2013.01); *H01R 24/86* (2013.01)

(58) Field of Classification Search
CPC .. H01R 13/6592; H01R 13/6582; H01R 9/03; H01R 24/86
(Continued)

(56) References Cited

U.S. PATENT DOCUMENTS 4,243,290 A * 1/1981 Williams ..... H01R 9/032 439/607.52
6,048,227 A * 4/2000 Rupp ..... H01R 9/0521 439/607.41
(Continued)

FOREIGN PATENT DOCUMENTS

DE 4107714 C1 7/1992
DE 19751786 A1 5/1999
(Continued)

OTHER PUBLICATIONS

PCT International Search Report and the Written Opinion of the International Searching Authority, dated Apr. 30, 2018, 11 pages.
(Continued)

*Primary Examiner* — Harshad C Patel
(74) *Attorney, Agent, or Firm* — Barley Snyder

(57) ABSTRACT

A connector includes a metal housing, an insulating body received in the metal housing, a conductive terminal held in the insulating body and electrically connected to a wire introduced into the metal housing, and a conductive shield mounted in the metal housing and sleeved on a conductive shielding layer of the wire. The conductive shield has a C-shaped ring adapted to electrically and elastically contact an inner wall of the metal housing and a plurality of elastic arms connected to a side of the C-shaped ring and adapted to electrically and elastically contact the conductive shielding layer.

20 Claims, 3 Drawing Sheets

(51) Int. Cl.
*H01R 13/6582* (2011.01)
*H01R 24/86* (2011.01)

(58) Field of Classification Search
USPC ..... 439/607.4
See application file for complete search history.

(56) References Cited

U.S. PATENT DOCUMENTS 7,101,223 B2 * 9/2006 Neumann ..... H01R 13/5808 439/585
7,416,448 B2 * 8/2008 Gaidosch ..... H01R 9/031 439/607.41
7,635,283 B1 * 12/2009 Islam ..... H01R 9/05 439/583
7,727,021 B2 * 6/2010 Haruna ..... H01R 9/037 439/607.41
7,857,661 B1 * 12/2010 Islam ..... H01R 9/0524 439/584
2007/0224880 A1 * 9/2007 Wlos ..... H01R 4/564 439/578
2009/0203256 A1 * 8/2009 Mathews ..... H01R 9/0524 439/583
2009/0280685 A1 * 11/2009 Gray ..... H01R 9/0527 439/607.41
2015/0099397 A1 * 4/2015 Listing ..... H01R 4/646 439/607.41

FOREIGN PATENT DOCUMENTS

EP 2568541 A1 3/2013
GB 2312341 A 10/1997

OTHER PUBLICATIONS

Abstract of DE4107714, dated Jul. 2, 1992, 1 page.
Abstract of EP2568541, dated Mar. 13, 2013, 1 page.
Abstract of DE19751786, dated May 27, 1999, 2 pages.

* cited by examiner

CONNECTOR WITH A CONDUCTIVE SHIELD HAVING A C-SHAPED RING

CROSS-REFERENCE TO RELATED APPLICATIONS

This application is a continuation of PCT International Application No. PCT/EP2018/057207, filed on Mar. 21, 2018, which claims priority under 35 U.S.C. § 119 to Chinese Patent Application No. 201720287264.9, filed on Mar. 22, 2017.

FIELD OF THE INVENTION

The present invention relates to a connector and, more particularly, to a connector with a conductive shield.

BACKGROUND

A circular connector for instruments, control apparatus, and electrical equipment generally includes an insulating body, a conductive terminal held in the insulating body, a metal housing sleeved on the insulating body, and a conductive shield mounted in an end of the metal housing. A wire may be introduced into the connector from the end of the metal housing and is electrically connected to the conductive terminal in the connector. The conductive shield is sleeved on a conductive shielding layer of the wire and provides electromagnetic shielding for the wire, so as to ensure signal transmission quality.

The conductive shield is usually formed as a rigid cylindrical component, and a front end of the conductive shield presses the conductive shielding layer of the wire against an inner annular protrusion of the metal housing to achieve an electrical connection between the conductive shield, the conductive shielding layer, and the metal housing. However, such a single-point rigid contact leads to an unstable electrical connection and the electromagnetic shielding effect deteriorates. In addition, the present conductive shield has a large volume, occupies a large space, and also is difficult to assemble and disassemble.

SUMMARY

A connector includes a metal housing, an insulating body received in the metal housing, a conductive terminal held in the insulating body and electrically connected to a wire introduced into the metal housing, and a conductive shield mounted in the metal housing and sleeved on a conductive shielding layer of the wire. The conductive shield has a C-shaped ring adapted to electrically and elastically contact an inner wall of the metal housing and a plurality of elastic arms connected to a side of the C-shaped ring and adapted to electrically and elastically contact the conductive shielding layer.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
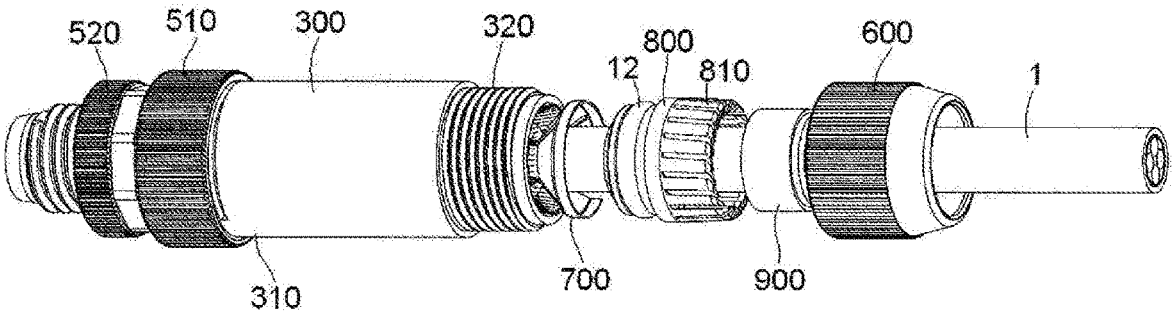
FIG. 1 is an exploded perspective view of a connector according to an embodiment.

The present disclosure will be described in further detail with reference to the following embodiments, taken in conjunction with the accompanying drawings. In the specification, the same or similar references indicate the same or similar components. The following description of embodiments of the present disclosure with reference to the accompanying drawings is intended to explain the general inventive concept of the present disclosure and should not be construed as limiting the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
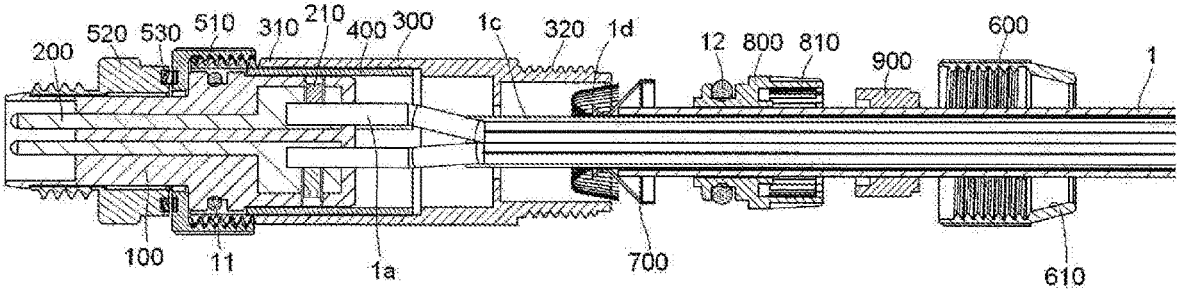
FIG. 2 is an exploded sectional side view of the connector.

A connector according to an embodiment, as shown in FIGS. 1 and 2, comprises a metal housing 300, an insulating body 100, a conductive terminal 200, and a conductive shield 700. The insulating body 100 is received in the metal housing 300. The conductive terminal 200 is held in the insulating body 100 and adapted to be electrically connected to a wire 1 inserted into the metal housing 300. The conductive shield 700 is, for example, shaped as a sleeve and mounted in the metal housing 300. In the shown embodiment, the connector is formed as a circular connector with a circular cross-section. In other embodiments, however, the connector may be formed as another type of connector.

Figure 3:
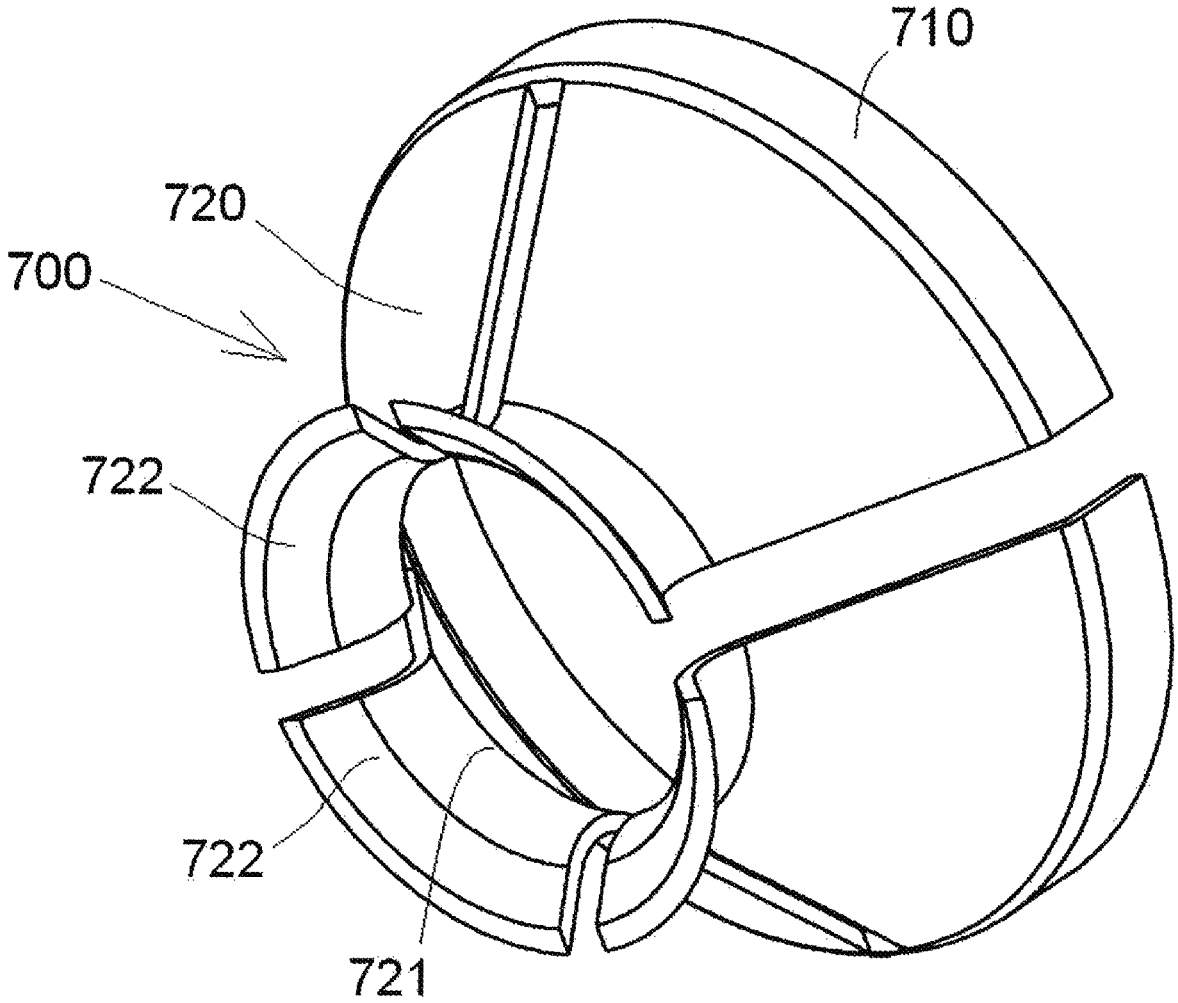
FIG. 3 is a perspective view of a conductive shield of the connector.

As shown in FIG. 3, the conductive shield 700 includes a C-shaped ring 710 and a plurality of elastic arms 720 connected to a side of the C-shaped ring 710.

Figure 4:
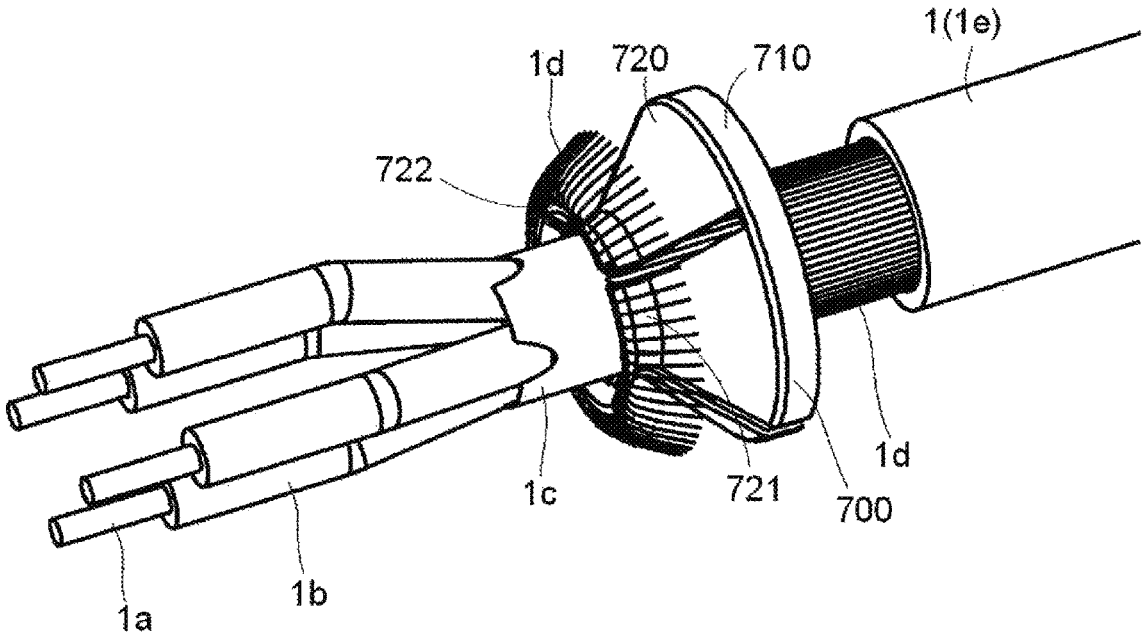
FIG. 4 is a perspective view of the conductive shield sleeved on a conductive shielding layer of a wire.

The wire 1, as shown in FIG. 4, is formed as a multi-core wire having a plurality of conductor cores 1*b*, each of which includes a conductor 1*a*. The plurality of conductor cores 1*b* are wrapped by an inner insulating layer 1*c*. A conductive shielding layer 1*d* wraps around the inner insulating layer 1*c* and an outer cladding layer 1*e* wraps around the conductive shielding layer 1*d*. The layers of the wire 1 may be different in other embodiments.

Figure 5:
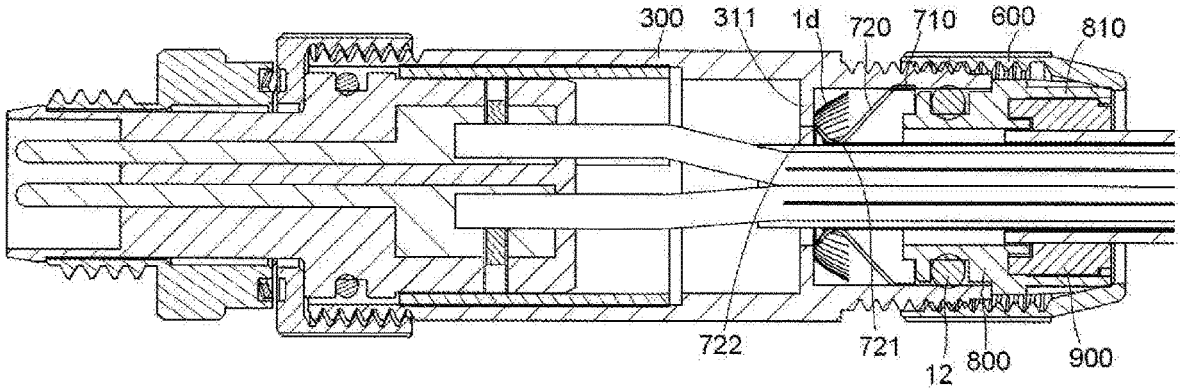
FIG. 5 is a sectional side view of the connector in an assembled state.

The C-shaped ring 710, as shown in FIG. 5, is adapted to electrically and elastically contact an inner wall of the metal housing 300. As shown in FIGS. 4 and 5, the plurality of elastic arms 720 are adapted to electrically and elastically contact the conductive shielding layer 1*d*. The plurality of elastic arms 720 are disposed to be spaced apart from each other around the wire 1 so that the plurality of elastic arms 720 are sleeved on the conductive shielding layer 1*d* of the wire 1.

As shown in FIGS. 3, 4 and 5, each elastic arm 720 has an elastic contact portion 721 projecting inwardly. When the plurality of elastic arms 720 are sleeved on the conductive shielding layer 1*d* of the wire 1, the elastic contact portions 721 compress the conductive shielding layer 1*d* in a radial direction of the wire 1 so as to electrically and elastically contact the conductive shielding layer 1*d*. Each elastic arm 720 has an elastic end portion 722 turned outwardly from the elastic contact portion 721. The elastic end portions 722 of the plurality of elastic arms 720 are adapted to press the conductive shielding layer 1*d* against an inner annular protrusion 311 of the metal housing 300 in an axial direction of the wire 1, so that the conductive shielding layer 1*d* comes into electrical contact with the metal housing 300.

The connector, as shown in FIGS. 1, 2, and 5, comprises a rear sleeve 800 adapted to be sleeved on the wire 1. The rear sleeve 800 has a cylindrical body and a plurality of elastic claws 810 connected to an outer end of the cylindrical body.

The connector, as shown in FIGS. 1, 2, and 5, comprises an elastic sealing sleeve 900 adapted to be sleeved on the outer cladding layer 1*e* of the wire 1 and a threaded sleeve 600 screwed on the metal housing 300. The plurality of elastic claws 810 are disposed around an outer periphery of the elastic sealing sleeve 900 and adapted to press the elastic sealing sleeve 900 against the outer cladding layer 1*e* of the wire 1 while being pressed by the threaded sleeve 600.

The threaded sleeve 600, as shown in FIGS. 1, 2, and 5, has a tapered inner wall 610 that gradually tapers outwardly and is adapted to press the plurality of elastic claws 810 against the elastic sealing sleeve 900, so that the elastic sealing sleeve 900 is pressed against the outer cladding layer 1*e* of the wire 1.

As shown in FIGS. 1, 2 and 5, the metal housing 300 has a first end 310 and a second end 320. The rear sleeve 800 is partly received in the second end 320 of the metal housing 300, and the threaded sleeve 600 is screwed on the second end 320 of the metal housing 300.

The plurality of elastic claws 810, as shown in FIG. 5, are located outside of the metal housing 300 when the rear sleeve 800 is assembled into the metal housing 300, in this way, the rear sleeve 800 may be easily removed from the metal housing 300. An outer wall at an inner end, a left end of FIGS. 2 and 5, of the cylindrical body of the rear sleeve 800 is formed with an annular groove in which a sealing ring 12 is accommodated, the sealing ring 12 being compressed between the rear sleeve 800 and the metal housing 300.

The insulating body 100, as shown in FIGS. 1, 2, and 5, is received in the first end 310 and the wire 1 is introduced into the connector from the second end 320 of the metal housing 300. The connector comprises a first nut 510 screwed on the first end 310 of the metal housing 300 and adapted to secure the insulating body 100 in the metal housing 300. One end of the insulating body 100 protrudes from the first end 310 of the metal housing 300. The connector further comprises a second nut 520 sleeved on the end of the insulating body 100 protruding from the first end 310 of the metal housing 300, the second nut 520 being adapted to be screwed to a mating connector mated with the present connector. An elastic conductive member 530 is provided between the first nut 510 and the second nut 520 and is compressed therebetween, so that the first nut 510 and the second nut 520 are electrically connected.

The connector, as shown in FIGS. 1, 2, and 5, comprises a plurality of screws 210 adapted to be screwed to an end of the conductive terminal 200 and constructed to press and secure a conductor 1*a* of the wire 1 inserted into the connector onto the end of the conductive terminal 200, so as to electrically connect the wire 1 to the conductive terminal 200. The connector further comprises an insulating and isolating sleeve 400 sleeved on the insulating body 100 to electrically isolate the screw 210 from the metal housing 300, so as to prevent electrical connection between the conductive terminal 200 and the metal housing 300 via the screw 210.

As shown in FIG. 2, an outer wall of the insulating body 100 is formed with an annular groove in which a sealing ring 11 is accommodated, the sealing ring 11 being compressed between the insulating body 100 and the metal housing 300.

In the above embodiments, the conductive shield 700 electrically and elastically contacts the metal housing 300 and the conductive shielding layer 1*d* at two different locations, respectively, thus stability of electrical connection between the conductive shield 700, the conductive shielding layer 1*d* and the metal housing 300 is improved. In addition, in the above exemplary embodiments, the conductive shield 700 has a small volume and is easy to assemble and disassemble.

It should be appreciated for those skilled in this art that the above embodiments are intended to be illustrative. Many modifications may be made to the above embodiments by those skilled in this art, and various features described in different embodiments may be freely combined with each other without conflicting in configuration or principle.

Although the present disclosure has been described with reference to the accompanying drawings, the embodiments disclosed in the drawings are intended to be illustrative of the embodiments of the invention and are not to be construed as limiting the invention. Although several exemplary embodiments have been shown and described, it would be appreciated by those skilled in the art that various changes or modifications may be made to these embodiments without departing from the principles and spirit of the disclosure, the scope of which is defined in the claims and their equivalents.

What is claimed is:

1. A connector, comprising:

a metal housing;

an insulating body received in the metal housing;

a conductive terminal held in the insulating body and electrically connected to a wire introduced into the metal housing; and a conductive shield mounted in the metal housing and sleeved on a conductive shielding layer of the wire, the conductive shield having a C-shaped ring adapted to electrically and elastically contact an inner wall of the metal housing and a plurality of elastic arms connected to a side of the C-shaped ring and adapted to electrically and elastically contact the conductive shielding layer.

2. The connector of claim 1, wherein the elastic arms are spaced apart from each other around the wire so that the elastic arms are sleeved on the conductive shielding layer.

3. The connector of claim 1, wherein each of the elastic arms has an elastic contact portion projecting inwardly, and when the elastic arms are sleeved on the conductive shielding layer, the elastic contact portions compress the conductive shielding layer in a radial direction of the wire to electrically and elastically contact the conductive shielding layer.

4. The connector of claim 3, wherein each of the elastic arms has an elastic end portion turned outwardly from the elastic contact portion, the elastic end portions of the elastic arms are adapted to press the conductive shielding layer against an inner annular protrusion of the metal housing in an axial direction of the wire so that the conductive shielding layer electrical contacts the metal housing.

5. The connector of claim 1, further comprising a rear sleeve adapted to be sleeved on the wire and having a cylindrical body and a plurality of elastic claws connected to an outer end of the cylindrical body.

6. The connector of claim 5, further comprising an elastic sealing sleeve adapted to be sleeved on an outer cladding layer of the wire.

7. The connector of claim 6, further comprising a threaded sleeve screwed on the metal housing, the elastic claws are disposed around an outer periphery of the elastic sealing sleeve and press the elastic sealing sleeve against an outer cladding layer of the wire while being pressed by the threaded sleeve.

8. The connector of claim 7, wherein the threaded sleeve has a tapered inner wall that gradually tapers outwardly and is adapted to press the elastic claws against the elastic sealing sleeve, pressing the elastic sealing sleeve against the outer cladding layer.

9. The connector of claim 7, wherein the metal housing has a first end and a second end, the rear sleeve is partly received in the second end of the metal housing and the threaded sleeve is screwed on the second end of the metal housing.

10. The connector of claim 9, wherein the elastic claws are located outside of the metal housing when the rear sleeve is assembled into the metal housing.

11. The connector of claim 10, wherein an outer wall at an inner end of the cylindrical body of the rear sleeve has an annular groove in which a sealing ring is disposed, the sealing ring compressed between the rear sleeve and the metal housing.

12. The connector of claim 9, wherein the insulating body is received in the first end and the wire is introduced into the connector from the second end of the metal housing.

13. The connector of claim 12, further comprising a first nut screwed on the first end of the metal housing and securing the insulating body in the metal housing.

14. The connector of claim 13, wherein an end of the insulating body protrudes from the first end of the metal housing.

15. The connector of claim 14, further comprising a second nut sleeved on the end of the insulating body protruding from the first end of the metal housing, the second nut adapted to be screwed to a mating connector.

16. The connector of claim 15, wherein an elastic conductive member is disposed between the first nut and the second nut and compressed between the first nut and the second nut so that the first nut and the second nut are electrically connected.

17. The connector of claim 1, wherein the connector is a circular connector with a circular cross-section.

18. The connector of claim 1, further comprising a screw screwed on an end of the conductive terminal.

19. The connector of claim 18, wherein the screw presses and secures a conductor of the wire onto the end of the conductive terminal to electrically connect the wire to the conductive terminal.

20. The connector of claim 19, further comprising an insulating and isolating sleeve sleeved on the insulating body to electrically isolate the screw from the metal housing and prevent electrical connection between the conductive terminal and the metal housing via the screw.

* * * * *